US009771748B2

(12) United States Patent
Crowder, II

(10) Patent No.: US 9,771,748 B2
(45) Date of Patent: Sep. 26, 2017

(54) AUTOMATED CLOSING DEVICE FOR SLIDING SCREEN DOOR PANEL

(71) Applicant: Ron Crowder, II, Rowland Heights, CA (US)

(72) Inventor: Ron Crowder, II, Rowland Heights, CA (US)

( * ) Notice: Subject to any disclaimer, the term of this patent is extended or adjusted under 35 U.S.C. 154(b) by 0 days.

(21) Appl. No.: 14/877,581

(22) Filed: Oct. 7, 2015

(65) Prior Publication Data

US 2017/0101813 A1 Apr. 13, 2017

(51) Int. Cl.

| | |
|---|---|
| ***E05F 1/08*** | (2006.01) |
| ***E05F 1/10*** | (2006.01) |
| ***E05F 1/16*** | (2006.01) |
| ***E05F 3/18*** | (2006.01) |

(52) U.S. Cl.

CPC . *E05F 1/16* (2013.01); *E05F 3/18* (2013.01)

(58) Field of Classification Search

CPC ... Y10T 16/593; Y10T 16/568; Y10T 16/287; E05F 1/16; E05F 1/10; E05F 1/1041; E05F 3/16; E05F 3/18; E05Y 2900/40; E05Y 2900/402; E05Y 2900/404; E05Y 2201/482; E05Y 2900/484; E05Y 2900/49; E05Y 2900/644; E05Y 2900/654; E05Y 2900/658; E05Y 2900/664

See application file for complete search history.

(56) References Cited

U.S. PATENT DOCUMENTS

| | | | | | |
|---|---|---|---|---|---|
| 149,941 | A * | 4/1874 | McKay | E05F 1/1008 | 16/78 |
| 2,992,450 | A * | 7/1961 | Pittenger | E05F 1/16 | 16/198 |
| 3,018,507 | A * | 1/1962 | Launer | E05F 1/16 | 16/78 |
| 4,649,597 | A * | 3/1987 | Cacicedo | E05F 1/1215 | 16/253 |
| 4,783,881 | A * | 11/1988 | Ho | E05F 1/1008 | 16/72 |
| 4,819,295 | A * | 4/1989 | Kaftan | E05F 1/16 | 16/71 |
| 5,937,478 | A * | 8/1999 | Regnier | E05F 1/16 | 16/77 |
| 6,021,607 | A * | 2/2000 | Angove | E05F 1/16 | 16/78 |
| 6,126,222 | A * | 10/2000 | Nguyen | E05C 17/36 | 16/82 |
| 6,189,181 | B1 * | 2/2001 | Bissett | E05F 5/00 | 16/77 |
| 6,530,249 | B1 * | 3/2003 | Burkhead | B60D 1/06 | 280/507 |

(Continued)

FOREIGN PATENT DOCUMENTS

JP 01080685 A * 3/1989

*Primary Examiner* — Chuck Mah

(74) *Attorney, Agent, or Firm* — Michael E. Broms; Spencer Fane LLP

(57) ABSTRACT

A device that has adjustable torque, and is used for the mechanical automation of closing a sliding screen door panel in a manner that is consistent with the force of a natural beings manual operation of the sliding screen door panel. The device is engineered to be consistent with the design of the said sliding screen panel, to prevent failure of the sliding screen panel after longterm continuous use with the device.

2 Claims, 1 Drawing Sheet

(56) References Cited

U.S. PATENT DOCUMENTS

| | | | | |
|---|---|---|---|---|
| 6,728,992 | B1 * | 5/2004 | Rogers | E05F 1/1041 16/76 |
| 8,656,554 | B1 * | 2/2014 | Burleson | E05F 1/1066 16/72 |

* cited by examiner

AUTOMATED CLOSING DEVICE FOR SLIDING SCREEN DOOR PANEL

FIELD OF THE INVENTION

The automation of closing an opening, in particular the closing of a sliding screen door panel.

BACKGROUND OF THE INVENTION

Related screen door closing devices are abundant in prior art. Past art indicates devices that are complicated in nature including but not limited to the way it is attached, location of device on or around said opening, mechanism for automation, and the amount of components essential to function properly within the device.

In U.S. Pat. No. 5,937,478 a torsion spring is used to operate the device, though the torsion springs rigidness does not allow for a wide range of torque, and may or may not close the screen door panel successfully. Range of torque is addressed in U.S. Pat. No. 5,659,999, though the range of torsion is adjustable, the amount of components used for the device to function properly is not ideal for the manufacturing process and cost efficiency.

Some devices require a permanent structure to attach to, in a permanent manner, as seen in U.S. Pat. No. 5,630,249 making installation difficult or impossible if no other structure exists to attach the device to, as in door location being on the corner of a structure. Other devices installation locations are not ideal, causing an unbalanced distribution of force on the sliding screen door panel, this could subsequently result in the failure of the said sliding screen door panel.

SUMMARY OF THE INVENTION

Automating the closing of a sliding screen door in a manner that is consistent with the force of a natural beings manual operation of the sliding screen door panel, and consequently consistent with the design of the sliding screen door panel, to prevent failure of said panel after continuous, non-abusive, operation of said panel.

The attachment of the device will be straight forward and uncomplicated in nature, or design. An adhesive, double sided mounting tape with a weight capacity consistent with its use, will secure the device to the sash edge of the anchored glass panel. This location is between and parallel to the sliding glass panel and sliding screen panel, approximately centered, and horizontally in line with the manual operating handle of the sliding screen panel. The support will also be attached with same type of adhesive, double sided mounting tape, to the trailing frame of the sliding screen panel, horizontally in line with the manual operating handle of the sliding screen panel. The support and device will be joined by way of polly braid and clasp. At one end, the polly braid is permanently attached to the devices internal mechanism, in particular the cylinder. At the other end the poly braid is permanently attached to the closed end of the clasp, the open end of the clasp is attached to the support.

When the device is installed, the screen panel being in a closed position the poly braid will be spooled around the cylinder under a preset pressure from the torqued spring. When the sliding screen panel is opened manually the attached support pulls the clasp, and subsequently the spooled poly braid, which causes the cylinder to move in a circular direction around its axis, in this case the axis being the dowel. The dowel torques the spiral torsion spring further than the preset torque causing a graduating pressure on the dowel, cylinder, poly braid, clasp, support, and screen panel sash. Once the manual pressure is no longer present the screen panel closes in an automated manner due to the graduating pressure, or force of the torqued spiral torsion spring attached to the dowel, cylinder, poly braid, clasp, support, and sliding screen panel.

The device is adjustable and can be set to different torque settings in a non complicated way. These torque settings are accomplished by applying manual pressure in an upward and twisting motion on the dial at the bottom of the device. When applying upward manual pressure, the compression cap, located at the top of the cylinder, will compress against the top of the housing, causing the dial and subsequently the dial tabs to move upward and out of there tab slots. When twisting the dial, torque will increase or decrease depending on the direction you twist the dial. Once the desired torque is achieved stop applying the upward pressure but continue to hold the dial in the position of the desired torque, twist slightly in either direction until the dial tabs align and set back into the tab slots.

The device can also be completely disengaged without uninstalling, so that the door can be quickly operated manually, in its original state. This can be accomplished by simply uncoupling the open end of the clasp from the support.

DETAILED DESCRIPTION OF INVENTION

Figure 1:
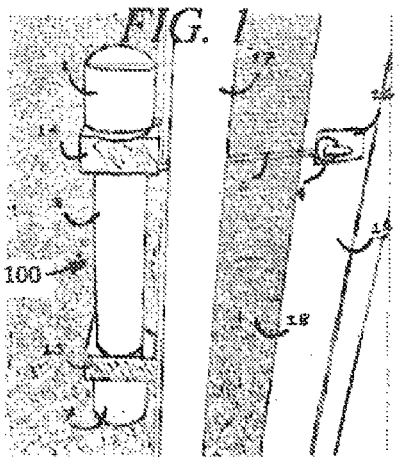
FIG. 1, is the device installed on the sash edge of the anchored glass panel.
Figure 2:
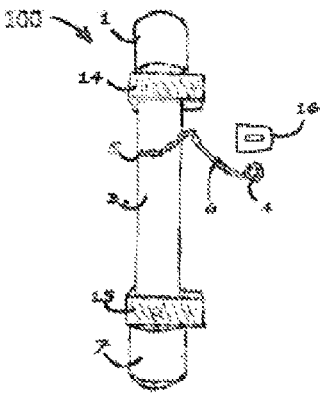
FIG. 2, is the device in its entirety, uninstalled.
Figure 3:
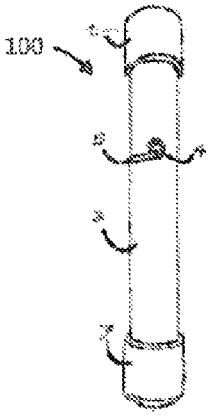
FIG. 3, is the device without upper brace, lower brace or clasp support.
Figure 4:
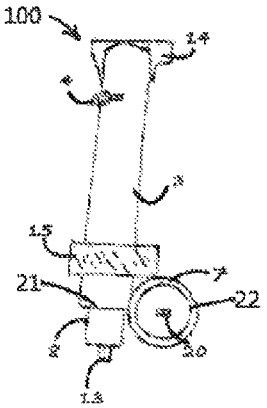
FIG. 4, is the lower portion of the device with a top view of the detached dial.
Figure 5:
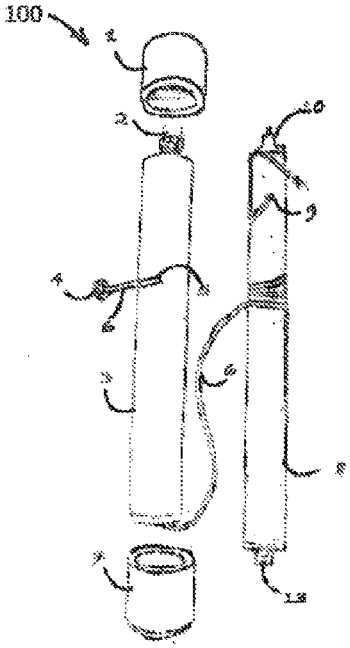
FIG. 5, is the device partially disassembled exposing the cylinder.
Figure 6:
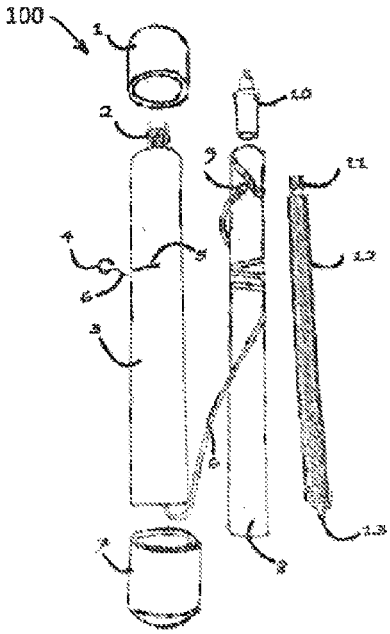
FIG. 6, is the device disassembled further , exposing the spiral torsion spring assembly.

With reference to FIG. 1-6 the device designated by the number 100 attached to the anchored glass panel sash edge 17 by way of upper brace 14 and lower brace 15. When the sliding screen panel 18 is manual operated towards the open position, the sliding screen panel frame 19 moves the attached support 16 consequently pulling the clasp 4 that is attached to polly braid 6. The polly braid 6 is permanently attached to the cylinder 8 through the orifice 9, and leaves the device 100 through the cover slit 5 causing the cylinder 8 to rotate within the cover 3. When the cylinder 8 rotates, it causes the spiral torsion spring 12 to torque, creating tension on the polly braid 6 and subsequently the sliding screen panel frame 19, causing the sliding screen panel 18 to close when the manual operation pressure is no longer present.

The spiral torsion spring 12 within the cover 3 is permanently affixed to the Dowel 11 at one end and permanently affixed to the cylinder 8 at the other end. The key 13 is permanently affixed to the end of the dowel 11 and fits tightly inside the dial lock 20, located at the bottom of the dial 7. The device 100 can be adjusted to apply more or less tension. Torque settings are accomplished by applying manual pressure in an upward and twisting motion on the dial 7 at the bottom of the device. When applying upward manual pressure, the compression cap 10, located at the top of the cylinder 8, will compress against the spacer 2 permanently affixed to the top of the housing 1, causing the dial 7 and subsequently the dial tabs 22 to move upward and out of the tab slots 21. When rotating the dial 7, torque will increase or decrease depending on the direction rotated.

What is claimed is:

1. a sliding screen door closing device comprising:

(a) a dowel comprising an upper distal end and lower distal end; the upper distal end is attached to a compression cap; the lower distal end is attached to a key;

(b) a torsion spring comprising a upper spring distal end and lower spring distal end; the dowel positioned inside the torsion spring along a central axis of rotation of the torsion spring; the upper spring distal end is attached to the dowel;

(c) a hollow cylinder dimensioned to enclose the torsion spring, comprising an upper end and a lower end; the upper end coupled to the compression cap; the lower end attached to the lower spring distal end;

(d) a cover dimensioned to enclose the cylinder comprising: an interior surface; an upper cover distal end; a lower cover distal end; and a slit extending through the cover;

(e) a poly braid comprising a first end and second end; the poly braid slideably secured through the slit of the cover; the first end permanently attached to an exterior surface of the cylinder; the poly braid dimensioned to wrap around the exterior surface of the cylinder within a cavity disposed between the exterior surface of the cylinder and the interior surface of the cover;

(f) a top cap having a spacer secured to an interior side of the top cap; the top cap is secured to the upper cover distal end; whereby the spacer is demountably connected to the compression cap; and (g) a dial attached to the key; the dial rotatably attached to the lower cover distal end; whereby the torsion spring is capable of being torqued by rotation of the dial.

2. A method of closing a sliding screen door comprising the steps of:

(a) providing a sliding screen door closing device comprising:

i. a dowel comprising an upper distal end and lower distal end; the upper distal end is attached to a compression cap; the lower distal end is attached to a key;

ii. a torsion spring comprising a upper spring distal end and lower spring distal end; the dowel positioned inside the torsion spring along a central axis of rotation of the torsion spring; the upper spring distal end is attached to the dowel;

iii. a hollow cylinder dimensioned to enclose the torsion spring, comprising an upper end and a lower end; the upper end coupled to the compression cap; the lower end attached to the lower spring distal end;

iv. a cover dimensioned to enclose the cylinder comprising: an interior surface; an upper cover distal end; a lower cover distal end; and a slit extending through the cover;

v. a poly braid comprising a first end and second end; the poly braid slideably secured through the slit of the cover; the first end permanently attached to an exterior surface of the cylinder; the poly braid dimensioned to wrap around the exterior surface of the cylinder within a cavity disposed between the exterior surface of the cylinder and the interior surface of the cover;

vi. a top cap having a spacer secured to an interior side of the top cap; the top cap is secured to the upper cover distal end; whereby the spacer is demountably connected to the compression cap; and vii. a dial attached to the key; the dial rotatably attached to the lower cover distal end; whereby the torsion spring is capable of being torqued by rotation of the dial;

(b) securing the cover to a stationary door sash;

(c) attaching the second end of the poly braid to a sliding screen door in a closed position;

(d) opening the sliding screen door; whereby a spring torque is created in the torsion spring through rotation of the cylinder relative to the dowel by a linear motion of the poly braid through the slit; and (e) releasing the screen door; whereby the screen door is closed by a linear force created through the poly braid by rotation of the cylinder by means of the spring torque.

* * * * *